US009497993B2

(12) United States Patent
Vallar

(10) Patent No.: US 9,497,993 B2
(45) Date of Patent: Nov. 22, 2016

(54) PROCESS FOR REFILLING AN ELECTRONIC CIGARETTE

(71) Applicants: Ramon Manolo Vallar, Turin (IT); Alessio Cipullo, San Mauro Torinese (IT); Filippo Riccio, Turin (IT); Alessandro Riccio, Venaria Reale TO (IT)

(72) Inventor: Ramon Manolo Vallar, Turin (IT)

(73) Assignees: Ramon Manolo Vallar, La Cassa—Turin (IT); Alessio Cipullo, Turin (IT); Filippo Riccio, Turin (IT); Alessandro Riccio, Venaria Reale TO (IT)

( * ) Notice: Subject to any disclaimer, the term of this patent is extended or adjusted under 35 U.S.C. 154(b) by 0 days.

(21) Appl. No.: 14/898,815

(22) PCT Filed: Jun. 17, 2014

(86) PCT No.: PCT/IB2014/001096

§ 371 (c)(1),
(2) Date: Dec. 16, 2015

(87) PCT Pub. No.: WO2014/203063

PCT Pub. Date: Dec. 24, 2014

(65) Prior Publication Data

US 2016/0120219 A1 May 5, 2016

(30) Foreign Application Priority Data

Jun. 18, 2013 (IT) ..... TO2013A0499
May 29, 2014 (IT) ..... TO2014A0430

(51) Int. Cl.
*A24F 47/00* (2006.01)
*A24B 15/00* (2006.01)
*B65B 3/04* (2006.01)

(52) U.S. Cl.
CPC ..... *A24F 47/002* (2013.01); *A24B 15/00* (2013.01); *B65B 3/04* (2013.01); *A24F 47/008* (2013.01)

(58) Field of Classification Search
CPC ..... A61M 2209/045; A24B 15/24
See application file for complete search history.

(56) References Cited

U.S. PATENT DOCUMENTS

| | | | | |
|---|---|---|---|---|
| 9,247,773 | B2 * | 2/2016 | Memari | A24F 15/12 |
| 2014/0261483 | A1 * | 9/2014 | Hopps | A24B 15/24 131/298 |
| 2014/0283946 | A1 * | 9/2014 | Kribs | B65D 47/06 141/2 |
| 2016/0073677 | A1 * | 3/2016 | Kappel | A24B 15/16 206/249 |

OTHER PUBLICATIONS

Anonymous: "How to Refill E-Liq", 2010.

* cited by examiner

*Primary Examiner* — Mark A Laurenzi
*Assistant Examiner* — Timothy P Kelly
(74) *Attorney, Agent, or Firm* — Jason D. Voight

(57) ABSTRACT

Process for refilling an electronic cigarette with refillable reservoir, implemented by means of a container (10) of a single dose of a concentrated aroma, in liquid state, for producing a liquid refill of said electronic cigarette, wherein said container (10) comprises at least a liquid reservoir (14) and a closed mouth (15), in liquid-tight communication with said reservoir (14), comprising the following steps: extracting said single dose of a concentrated aroma from said container (10), after opening said mouth (15); mixing said single dose of a concentrated aroma with a solvent medium, or diluent, obtaining a solution, or a heterogeneous compound, for producing at least one refill for said electronic cigarette; inserting, into the reservoir of said electronic cigarette, an amount of solution, or heterogeneous compound, corresponding to the amount required to produce this refill.

1 Claim, 3 Drawing Sheets

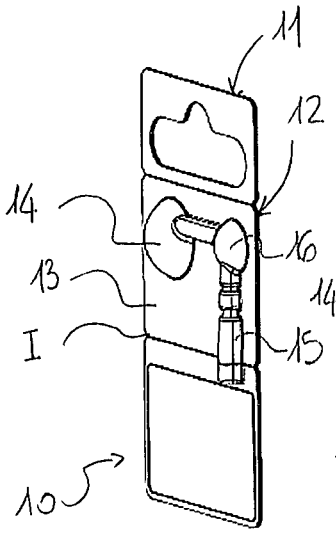
Fig. 3
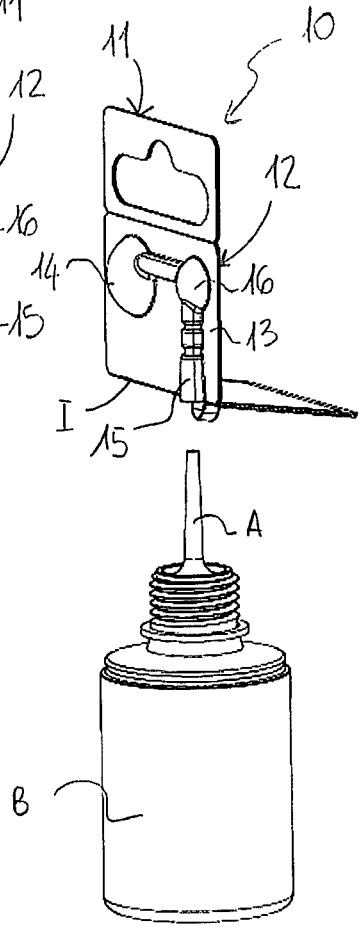
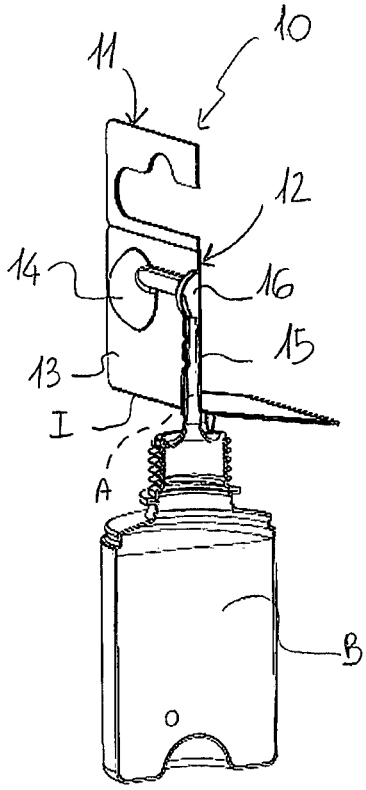
Fig. 5
Fig. 4

PROCESS FOR REFILLING AN ELECTRONIC CIGARETTE

This is the national stage of International Application PCT/IB2014/001096, filed Jun. 17, 2014.

The present invention relates to a process for refilling an electronic cigarette with a refillable reservoir.

To produce one or more refills of electronic cigarettes, neutral solutions that generate, during use, a substantially neutral water vapor are available in the state of the art.

In addition, further types of solutions, or heterogeneous compounds, premixed and comprising an aroma for generating, during use, an aromatized water vapor according to an aroma selected by the user are currently known and widely used.

Said solutions, or said heterogeneous compounds, premixed and aromatized, are produced industrially and marketed in specific pre-prepared bottles, usually containing an amount suitable to produce a plurality of refills.

The fact that said aromatized refills are produced according to an industrial production process necessarily implies a noteworthy limitation of the number of types that can be used to produce corresponding aromatized refills.

In fact, although not impossible, it would be very uneconomical to produce a large number of types of aromatized refills (in the order of more than ten/fifteen types).

For this reason, the number of types of premixed aromatized refills produced and subsequently marketed is necessarily limited.

It must also be considered that said industrial process for the production of aromatized refills for electronic cigarettes is currently somewhat complex.

Inevitably, the above implies limited possibilities of varying the choice by the user.

A partial answer to the problem set forth above consists in the production of bottles containing an aromatized concentrated, to be mixed with said neutral solution, in order to obtain an aromatized liquid for refilling electronic cigarette according to a selected aroma.

These are mainly bottles reclosable by means of a screw cap, suitable to be used several times.

However, although a similar solution effectively contributes to providing a wide choice of aromas for the user, thus offering a partial solution to the aforesaid problems, various relatively important problems still remain.

Firstly, during operations to open the container with the concentrate and subsequently to pour part of the content thereof into the neutral liquid container, there is a particularly high risk of accidental spillage and/or of contact of the aroma contained in said concentrate with the user's skin.

Moreover, the provision of a container that can be opened and closed by means of a cap or the like, produced to be used several times, contributes significantly to reducing the user's possibilities of varying the aroma.

In fact, once the bottle has been opened, it is advantageous for the concentrate contained therein to be consumed within a relatively limited period of time, in order to avoid dispersal of the aroma, making the remaining part of the liquid unusable.

Therefore, it is advantageous for the user to finish the bottle opened previously before opening a new one comprising a concentrate of a different aroma.

Consequently, the provision of a container with screw top opening or the like, besides subjecting the user to the aforesaid problem of exposing the skin to the risk of contact with the aroma contained in said concentrate, is also somewhat difficult to use, not least for the difficulty by the user, of obtaining the correct dosage of the two substances during mixing.

On the other hand, the use of said known containers of concentrated aroma, although considerably increasing the possibilities of choice of the aroma, do not enable any simultaneous mixing of two or more aromas with the same neutral liquid, except with the inevitable risk of wasting the amount of residual concentrate present in the respective containers.

Starting from the notion of the above drawbacks, the present invention aims to solve them.

An object of the present invention is to provide a process for refilling an electronic cigarette with refillable reservoir, which advantageously enables choosing from a considerable variety of aromas for producing aromatized refills for electronic cigarettes.

Another object of the present invention is to provide a process as indicated, which enables the user to obtain an aromatized liquid refill for an electronic cigarette, in a very easy and safe manner, greatly reducing the risk of contact of the aroma in the concentrate with the skin.

A further object of the present invention is to provide a process as stated, which enables the user to produce, according to preference, refills comprising different aromas, also by simultaneously mixing two or more aromas with the same neutral liquid, without this causing dispersal of the aroma, or waste of the remaining liquid.

Yet another object of the present invention is to provide a process as indicated, which enables the user to obtain, in a very easy manner, correct dosage between substances, during mixing thereof.

On the other hand, an object of the present invention is to provide a process as stated, the implementation of which is substantially simple and with a relatively limited cost.

In view of these objects, the present invention provides for a process for refilling an electronic cigarette with refillable reservoir, the essential feature of which forms the subject matter of claim 1.

Further advantageous features of the invention are described in the dependent claims.

The aforesaid claims are intended as fully incorporated herein.

More in particular, said process for refilling an electronic cigarette with refillable reservoir according to the present invention is implemented by means of a container of a single dose of a concentrated aroma, in liquid state, for producing a liquid refill of said electronic cigarette, wherein said container comprises at least a liquid reservoir and a closed mouth, in liquid-tight communication with said reservoir, and is characterized in that it comprises the following steps of:

extracting said single dose of a concentrated aroma from said container, after opening said mouth;

mixing said single dose of a concentrated aroma with a solvent medium, or diluent, obtaining a solution, or a heterogeneous compound, for the production of at least one refill for said electronic cigarette;

inserting, into the reservoir of said electronic cigarette, an amount of solution, or heterogeneous compound, corresponding to the amount required to produce this refill.

The present invention will become more apparent from the detailed description which follows, with reference to the drawing attached hereto, which is purely exemplary and therefore non-limiting, in which.

Figure 1:
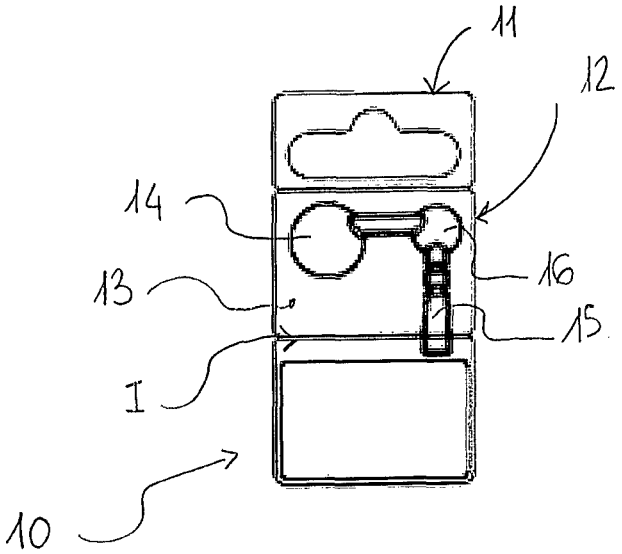
FIG. 1 is a front elevation view of a first example of single dose container of a component or aroma for implementation of the process according to a first example of implementation of the present invention.
Figure 2:
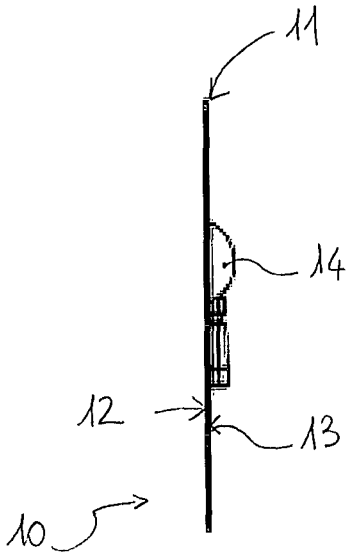
FIG. 2 is a side elevation view of the container of FIG. 1.
Figure 6:
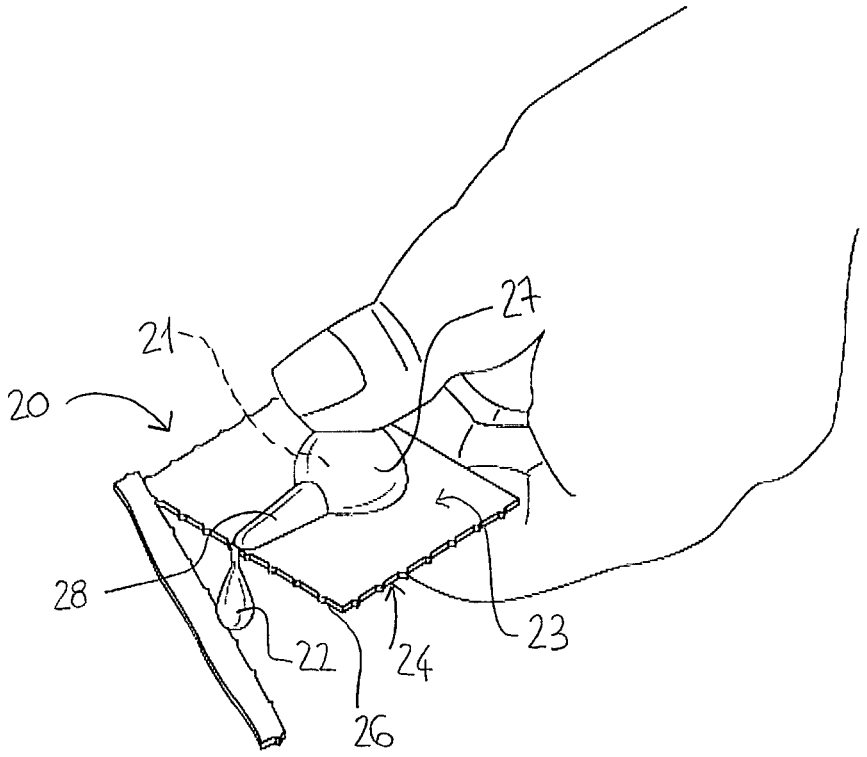

FIGS. 3 to 5 show a part of the sequence for producing an aromatized refill for electronic cigarettes according to said first method of implementation of the invention, by means of the use of the container of FIG. 1, where FIG. 3 is a perspective view of the container intact, FIG. 4 is a view similar to that of FIG. 3 but in which the container is shown open by breaking and FIG. 5 is a sectional view along the line V-V of FIG. 4;

FIG. 6 is a perspective view of a second example of single dose container of a component or aroma for implementation of the process according to a second example of implementation of the present invention.

In the aforesaid FIGS. 1 to 5, a single dose container of a component or aroma for producing a liquid for refilling electronic cigarettes is indicated with 10.

Said container 10 comprises (FIGS. 1 and 2):

a liquid-tight casing 11 including a flat support 12 having at least one waterproof surface and a shaped sheet 13 made of waterproof material, fixed in a liquid-tight manner to said waterproof side of said support 12;

at least one liquid reservoir 14 and one mouth 15 for liquid to pass through, connected to said reservoir 14 and closed in a liquid-tight manner, said reservoir 14 and said closed mouth 15 being provided in said shaped sheet 13 and being closed in a liquid-tight manner by means of said flat support 12.

More in particular, said container 10 contains a liquid substance comprising an aroma concentrate for producing a solution, or heterogeneous compound, for one or more refills of electronic cigarettes.

With particular reference to FIGS. 3 to 5, these show part of the sequence for producing an aromatized refill for electronic cigarettes, by means of the use of the container of FIG. 1.

As can be seen from the aforesaid Figures, the user, having opened said mouth 15 (FIG. 5), and positioned through a remaining part of the mouth a suction member A, pneumatically connected to a liquid suction device B (FIGS. 4 and 5), under vacuum, causes suction and at least partial delivery of the liquid contained in said reservoir 14 and collection thereof in said suction device B associated with said suction member A.

In particular, said suction device B is produced in the form of liquid-tight container of a neutral solution, in an amount substantially suitable for producing one or more refills of an electronic cigarette.

In this way, after said concentrate contained inside said container 10 has been drawn into said suction device B, a solution, or heterogeneous compound, is obtained for one or more refills of an electronic cigarette.

Advantageously, said container 10 comprises at least one preformed cut I in said casing 11 to facilitate manual breaking and removal of a part of said mouth 15, causing opening thereof.

Said container 10 can comprise, in a variant, at least one sealing cap (not shown) that closes said liquid-tight mouth and is opened by insertion of a cannula needle, connected to said liquid suction device B.

Advantageously, the container 10 also comprises a suction prechamber 16, connected in a liquid-tight manner on one side to said reservoir 14 and, on the other side, to said mouth 15. Firstly, this offers the advantage of further reducing the risk, when the container 10 is opened, of possible accidental spillage of the concentrate contained therein, and consequent undesirable contact with the skin.

In particular, the container 10 can be positioned, during the step to open the mouth 15, by breaking along the cut I, so that the component remains inside the reservoir 11, and is then drawn by suction due to the reservoir B into the suction prechamber 16.

Likewise, the presence of said suction prechamber 16 contributes greatly to facilitating these operations for suction of the concentrate.

To prevent accidental spillage of the concentrate during the step to insert said suction device B into said mouth 15 and in the subsequent suction step, said mouth 15 is shaped for positive fit connection with a suction nozzle A, when connected to said liquid suction device B.

Said mouth 15 has a conical trend tapered toward the outside (FIGS. 3 and 4).

Said shaped sheet 13 is preferably made of plastic material.

Said flat support 12 is a sheet of card treated on the surface with a waterproofing agent, or coated in plastic film. In fact, this achieves the technical effect of not allowing the fluid present in the container 10 to pass toward the outside, through means that are easy to produce and that have relatively limited costs.

With reference to FIG. 6, another embodiment of a single dose container for fluid products, suitable to contain a component or aroma for refilling electronic cigarettes is indicated with 20. Said single dose container 20 comprises a hermetic cavity 21 formed by means of a flexible sheet 23 fixed to a flat base 24. The cavity 21 has a semi-spherical shape 27 with a nose or mouth 28 oriented in the direction of a pre-break line 26. When the container 20 is broken along the said pre-break line 26, the fluid product 22 can be extracted from the cavity 21, by means of manual pressure at the hermetic cavity 21.

As can be understood from the above, the process for refilling an electronic cigarette with refillable reservoir according to the present invention is implemented by means of a container 10, 20 of a single dose of a concentrated aroma, in liquid state, for producing a liquid refill of said electronic cigarette, wherein said container 10, 20 comprises at least a liquid reservoir and a closed mouth, in liquid-tight communication with said reservoir.

According to the invention, said process comprises the following steps:

extracting said single dose of a concentrated aroma from said container, after opening said mouth;

mixing said single dose of a concentrated aroma with a solvent medium, or diluent, obtaining a solution, or a heterogeneous compound, for producing at least one refill for said electronic cigarette;

inserting, into the reservoir of said electronic cigarette, an amount of solution, or heterogeneous compound, corresponding to the amount required to produce this refill.

According to a first way of exemplary implementation of the process according to the invention, said extraction step is implemented by means of forced suction of a dose of concentrated liquid aroma from said container 10, by means of a liquid suction device.

According to a second way of exemplary implementation of the process according to the invention, said extraction step is implemented by means of forced ejection of a dose of concentrated liquid aroma from said container 20, by means of compression thereof.

As is apparent from the above, said process for refilling an electronic cigarette with refillable reservoir according to the present invention makes it possible to obtain, in an advantageous manner, a considerable variety of aromatized refills for electronic cigarettes, thus giving the user a vast possibility of choice.

Moreover, said process according to said first way of implementation of the invention enables the user to obtain an aromatized liquid refill for an electronic cigarette in a very easy and safe manner, greatly reducing the risk of the nicotine included in the concentrate coming into contact with the skin.

Moreover, said process as indicated enables the user to produce, according to preference, refills comprising different aromas, also by simultaneously mixing two or more aromas with the same neutral liquid, without this causing dispersal of the aroma, or waste of the remaining liquid.

Further, said process as indicated enables the user to obtain, in a very easy manner, a correct dosage between substances, during the related mixing.

As it appears from the above description, the present invention allows the objects described in the introduction to be achieved in a simple and advantageous manner.

The invention claimed is:

1. A process for refilling an electronic cigarette with refillable reservoir, implemented by a container of a single dose of a concentrated aroma, in liquid state, for producing a liquid refill of said electronic cigarette, wherein said container comprises at least a liquid reservoir and a closed mouth, in liquid-tight communication with said reservoir, said process comprising the following steps:

extracting said single dose of said concentrated aroma from said container after opening said mouth, implementing said extraction step by forced ejection of said dose of concentrated liquid aroma from said container, by compression thereof;

mixing said single dose of said concentrated aroma with a solvent medium, or diluent, thereby obtaining a solution, or a heterogeneous compound, for producing at least one refill for said electronic cigarette;

inserting, into the reservoir of said electronic cigarette, an amount of said solution, or said heterogeneous compound, corresponding to an amount required to produce said at least one refill.

* * * * *